US012345154B2

(12) United States Patent
Zeghlache

(10) Patent No.: US 12,345,154 B2
(45) Date of Patent: Jul. 1, 2025

(54) UNTETHERED LOGGING DEVICES AND RELATED METHODS OF LOGGING A WELLBORE

(71) Applicant: Saudi Arabian Oil Company, Dhahran (SA)

(72) Inventor: Mohamed Larbi Zeghlache, Al Khobar (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 337 days.

(21) Appl. No.: 17/932,139

(22) Filed: Sep. 14, 2022

(65) Prior Publication Data

US 2024/0084697 A1 Mar. 14, 2024

(51) Int. Cl.

| | |
|---|---|
| ***E21B 47/13*** | (2012.01) |
| ***E21B 23/04*** | (2006.01) |
| ***E21B 47/12*** | (2012.01) |

(52) U.S. Cl.

CPC ..... *E21B 47/138* (2020.05); *E21B 23/04* (2013.01)

(58) Field of Classification Search

CPC ... E21B 23/0413; E21B 47/138; B63B 22/20; B63B 22/26; B63B 22/06; B63B 22/08

See application file for complete search history.

(56) References Cited

U.S. PATENT DOCUMENTS

| | | | | |
|---|---|---|---|---|
| 2,558,427 | A | 6/1951 | Fagan | |
| 2,563,254 | A | 8/1951 | Lewis | |
| 2,735,498 | A * | 2/1956 | Muse | E21B 34/063 137/71 |
| 3,535,623 | A | 10/1970 | Wood | |
| 4,218,651 | A | 8/1980 | Ivy | |
| 4,258,318 | A | 3/1981 | Furukawa et al. | |
| 4,442,403 | A | 4/1984 | Pohler | |
| 4,808,925 | A | 2/1989 | Baird | |
| 5,050,674 | A | 9/1991 | Soliman et al. | |
| 5,555,945 | A | 9/1996 | Schultz | |
| 5,579,287 | A | 11/1996 | Boucher et al. | |
| 5,720,345 | A | 2/1998 | Price et al. | |
| 5,789,669 | A | 8/1998 | Flaum | |

(Continued)

FOREIGN PATENT DOCUMENTS

| | | |
|---|---|---|
| CA | 2858051 | 11/2016 |
| CN | 108112260 | 6/2018 |

(Continued)

OTHER PUBLICATIONS

Seren, H. R. et al. "An Untethered Sensor Platform for Logging Vertical Wal.la", IEEE Transactions On Instrumentation and Measurement, vol. 67, No. 4, Apr. 1, 2018 pp. 798-803 (6 pages).

(Continued)

*Primary Examiner* — Cathleen R Hutchins

(74) *Attorney, Agent, or Firm* — Osha Bergman Watanabe & Burton LLP

(57) ABSTRACT

An untethered device includes a housing, a chamber wall extending from the housing and defining a buoyancy chamber, and a discharge door. The discharge door is configured to be placed in a closed position that isolates a ballast weight within the buoyancy chamber and an open position that allows a release of the ballast weight from the untethered device to reduce a bulk density of the untethered device.

20 Claims, 5 Drawing Sheets

(56) References Cited

U.S. PATENT DOCUMENTS

| | | | | |
|---|---|---|---|---|
| 6,076,046 | A | 6/2000 | Vasudevan et al. | |
| 6,084,403 | A | 7/2000 | Sinclair et al. | |
| 6,411,084 | B1 | 6/2002 | Yoo | |
| 6,675,892 | B2 | 1/2004 | Kuchuk | |
| 6,832,515 | B2 | 12/2004 | Follini et al. | |
| 6,915,848 | B2 * | 7/2005 | Thomeer | E21B 47/138 166/250.11 |
| 7,024,930 | B2 | 4/2006 | Follini et al. | |
| 7,031,841 | B2 | 4/2006 | Zazivsky | |
| 7,032,661 | B2 | 4/2006 | Georgi et al. | |
| 7,036,578 | B2 | 5/2006 | Austbo et al. | |
| 7,054,751 | B2 | 5/2006 | Craig | |
| 7,117,734 | B2 | 10/2006 | Follini et al. | |
| 7,168,494 | B2 | 1/2007 | Starr et al. | |
| 7,210,334 | B2 | 5/2007 | Seghers et al. | |
| 7,263,880 | B2 | 9/2007 | Pop et al. | |
| 7,290,443 | B2 | 11/2007 | Follini et al. | |
| 7,363,967 | B2 | 4/2008 | Burris, II et al. | |
| 7,445,043 | B2 | 11/2008 | Mullins et al. | |
| 7,788,037 | B2 | 8/2010 | Soliman et al. | |
| 8,015,869 | B2 | 9/2011 | Nold, III | |
| 8,074,713 | B2 | 12/2011 | Ramos et al. | |
| 8,136,470 | B1 | 3/2012 | Buescher et al. | |
| 8,899,349 | B2 | 12/2014 | Rasmus et al. | |
| 8,981,957 | B2 | 3/2015 | Gano et al. | |
| 8,985,218 | B2 | 3/2015 | Bedouet et al. | |
| 9,033,045 | B2 | 5/2015 | Fincher | |
| 9,045,969 | B2 | 6/2015 | Waters | |
| 9,422,811 | B2 | 8/2016 | Bedouet et al. | |
| 9,477,002 | B2 | 10/2016 | Miller et al. | |
| 9,587,477 | B2 | 3/2017 | Lafferty et al. | |
| 9,650,851 | B2 | 5/2017 | Whitsitt et al. | |
| 10,301,910 | B2 | 5/2019 | Whitsitt et al. | |
| 10,316,645 | B2 | 6/2019 | Ingraham et al. | |
| 10,337,279 | B2 | 7/2019 | Frazier | |
| 10,364,629 | B2 | 7/2019 | Jacob et al. | |
| 10,502,044 | B2 | 12/2019 | Fouda et al. | |
| 10,577,921 | B2 | 3/2020 | Donderici et al. | |
| 10,704,369 | B2 | 7/2020 | Zeghlache et al. | |
| 10,711,599 | B2 | 7/2020 | Jaaskelainen et al. | |
| 10,718,175 | B2 | 7/2020 | Cabot et al. | |
| 10,900,351 | B2 | 1/2021 | Deffenbaugh et al. | |
| 11,047,218 | B2 | 6/2021 | Zeghlache et al. | |
| 11,111,773 | B1 | 9/2021 | Zeghlache | |
| 11,125,061 | B2 | 9/2021 | Zeghlache et al. | |
| 11,242,743 | B2 | 2/2022 | Seren et al. | |
| 11,332,991 | B2 | 5/2022 | Seren et al. | |
| 2002/0096322 | A1 | 7/2002 | Barrett | |
| 2005/0241825 | A1 | 11/2005 | Burris | |
| 2007/0079652 | A1 | 4/2007 | Craig | |
| 2007/0083331 | A1 | 4/2007 | Craig | |
| 2007/0277970 | A1 | 12/2007 | Botnmark | |
| 2009/0173504 | A1 | 7/2009 | McElhinney | |
| 2009/0250207 | A1 | 10/2009 | May | |
| 2009/0254171 | A1 | 10/2009 | Heikkila | |
| 2010/0268470 | A1 * | 10/2010 | Kamal | G01V 11/00 977/953 |
| 2011/0011583 | A1 * | 1/2011 | Niconoff | E21B 49/10 210/450 |
| 2012/0111559 | A1 | 5/2012 | Deady et al. | |
| 2014/0182844 | A1 | 7/2014 | Wutherich et al. | |
| 2014/0262232 | A1 | 9/2014 | Dusterhoft et al. | |
| 2015/0075777 | A1 | 3/2015 | Walters et al. | |
| 2015/0075778 | A1 | 3/2015 | Walters et al. | |
| 2015/0075779 | A1 | 3/2015 | Walters et al. | |
| 2015/0101798 | A1 | 4/2015 | Buytaert et al. | |
| 2015/0107855 | A1 * | 4/2015 | Murphree | E21B 47/138 166/381 |
| 2015/0275649 | A1 | 10/2015 | Orban et al. | |
| 2015/0338541 | A1 | 11/2015 | Nichols et al. | |
| 2016/0025961 | A1 | 1/2016 | Tripathy | |
| 2016/0069163 | A1 | 3/2016 | Tolman | |
| 2016/0168974 | A1 | 6/2016 | Donderici | |
| 2016/0320769 | A1 | 11/2016 | Deffenbaugh et al. | |
| 2017/0067328 | A1 | 3/2017 | Chauffe et al. | |
| 2017/0138187 | A1 | 5/2017 | Moronkeji et al. | |
| 2017/0101865 | A1 | 6/2017 | Khalaj Amineh et al. | |
| 2018/0334903 | A1 | 11/2018 | Lehr | |
| 2018/0363409 | A1 | 12/2018 | Frazier | |
| 2018/0371886 | A1 | 12/2018 | Zeghlache et al. | |
| 2019/0040734 | A1 | 2/2019 | Donderici et al. | |
| 2020/0400013 | A1 | 12/2020 | McBride | |
| 2021/0140311 | A1 | 5/2021 | Deffenbaugh et al. | |
| 2021/0364336 | A1 | 11/2021 | Machocki et al. | |
| 2022/0010648 | A1 | 1/2022 | Musso et al. | |
| 2022/0127953 | A1 | 4/2022 | Seren et al. | |
| 2022/0243583 | A1 | 8/2022 | Seren et al. | |
| 2022/0334286 | A1 | 10/2022 | Seren et al. | |

FOREIGN PATENT DOCUMENTS

| | | |
|---|---|---|
| EP | 2163724 | 3/2010 |
| EP | 2954151 | 12/2015 |
| EP | 3289179 | 3/2018 |
| IN | 397521 | 5/2022 |
| JP | 6518342 | 5/2019 |
| KR | 10-2023741 | 9/2019 |
| WO | WO 2009004336 | 1/2009 |
| WO | WO 2012173608 | 12/2012 |
| WO | 2016/176643 A1 | 11/2016 |
| WO | WO 2016176643 | 11/2016 |
| WO | WO 2017196357 | 11/2017 |
| WO | WO 2018084865 | 5/2018 |
| WO | WO 2020117231 | 6/2020 |
| WO | WO 2020220087 | 11/2020 |
| WO | WO 2020257742 | 12/2020 |
| WO | WO 2022011388 | 1/2022 |

OTHER PUBLICATIONS

Zeghlache, M. L. et al. "Sensor-Ball: Field Deployment of Autonomous and Untethered Surveillance" International Petroleum TechnologyConference, Riyadh, Saudi Arabia, [Online] Feb. 21, 2022 (24 pages).

Seren, H. R. et al. "Electro-permanent magnetic weight release mechanism for buoyancy control. of an autonomous well-logging tool" AIP Advances, American Institute of Physics, 2 Huntington Quadrangle, Melville, NY 11747, vol. 11, No. 2, Feb. 9, 2021 (7 pages).

International Search Report issued in International Application No. PCT/US2023/032498 dated Jan. 26, 2024 (5 pages).

Written Opinion issued in International Application No. PCT/US2023/032498 dated Jan. 26, 2024 (10 pages).

U.S. Appl. No. 17/234,555, filed Apr. 19, 2021, Seren et al.

U.S. Appl. No. 17/394,813, filed Aug. 5, 2021, Seren et al.

U.S. Appl. No. 17/538,739, filed Nov. 30, 2021, Zeghlache.

U.S. Appl. No. 17/949,819, filed Sep. 21, 2022, Zeghlache et al.

Al Macki et al., "Electromagnetic Corrosion Logs, Insights from Yard Test," SPE-188672-MS, Society of Petroleum Engineers, presented at the Abu Dhabi International Petroleum Exhibition and Conference in Abu Dhabi, UAE, Nov. 13-16, 2017, 9 pages.

Alverez et al., "Design, realization and field results of an inductive casing collar locator," IEEE Sensors Applications Symposium (SAS), Apr. 12, 2017, 4 pages.

Alverez et al., "Theory, Design, Realization, and Field Results of an Inductive Casing Collar Locator," IEEE Transactions on Instrumentation and Measurement, Apr. 2018, 67(4):760-766, 7 pages.

Bar-Kochba et al., "A Fast Iterative Digital Volume Correlation Technique for Large Deformation Measurements," Experimental Mechanics, 55:, Feb. 2014, 261-274, 14 pages.

bubbletightusa.com [online], "Innovative Materials," 2022, retrieved on Feb. 14, 2022, retrieved from URL <http://bubbletightusa.com/products/>, 9 pages.

Buljac et al., "Digital volume correlation: review of progress and challenges," Experimental Mechanics, 58:5, 2018, 661-708, 127 pages.

Buzi et al., "Sensor Ball: Modernized Logging." SPE-204791-MS, Society of Petroleum Engineers, Dec. 2021, 6 pages.

(56) References Cited

OTHER PUBLICATIONS

Buzi et al., "Sensor Ball: An Autonomous Untethered Logging Platform," OTC-30538-MS, Paper presented at the Offshore Technology Conference, Houston, Texas, USA, May 2020, 10 pages.
Chen et al., "Synthesis of Disruptive Technologies Leads to Design of Flowable Sensors for Reservoir Monitoring, Passively Retrievable Through Carrier Buoyancy," OTC-29599-MS, prepared for presentation at the Offshore Technology Conference held in Houston, Texas, USA, May 6-9, 2019, 12 pages.
Commons.wikimedia.org [online], "File:6DOF.svg" Feb. 2015, [retrieved on Apr. 7, 2021], retrieved from: URL <https://commons.wikimedia.org/w/index.php?curid-38429678>, 4 pages.
Deffenbaugh et al., "An Untethered Sensor for Well Logging," IEEE Sensors Applications Symposium (SAS), 2017, 5 pages.
Delmonte, "Molding and Casting of Metal/Polymer Composites," Metal/polymer composites, Springer, 1990, 37 pages.
Estrada et al., "Intuitive Interface for the Quantitative Evaluation of Speckle Patterns for Use in Digital Image and Volume Correlation Techniques," J. Applied Mechanics, 82:9 (095001), Sep. 2015, 5 pages.
Gahlin et al., "The particle size effect in abrasion studied by controlled abrasive surfaces," Wear, Jan. 1999, 224(1):118-125, 8 pages.
Garcia et al., "Successful Application of a New Electromagnetic Corrosion Tool for Well Integrity Evaluation in Old Wells Complete with Reduced Diameter Tubular," IPTC.16997, International Petroleum Technology Conference, Beijing, China, Mar. 26-28, 2013, 12 pages.
Gardner et al., "Barrier Verification During Plug and Abandonment Using Spectral Noise Logging Technology, Reference Cells Yard Test," Society of Petroleum Engineers, SPE/IADC-194075-MS, SPE/IASDC Drilling International Conference and Exhibition in the Hauge, the Netherlands, Mar. 5-7, 2019, 22 pages.
Gasda et al., "Wellbore Permeability Estimates from Vertical Interference Testing of Existing Wells," Energy Procedia, vol. 37, Jan. 1, 2013, 8 pages.
Hunting-intl.com [online], "Mechanical Centralizers and Decentralizers" Mar. 2015, [retrieved on Apr. 7, 2021], retrieved from: URL <http://www.hunting-intl.com/titan/wireline-hardware-and-accessories/mechanical-centralizers-and-decentralizers>, 1 page.
Kuchuk et al., "The use of Vertical Interference Testing to improve reservoir interference testing to improve reservoir characterization, " SPE, Oct. 18, 2000, 13 pages.
Pettitt-Schieber et al., "Testing Electromagnetic Multi-Pipe Thickness Tools in Azimuthally Constrained Defects for Deepwater Applications," Society of Petroleum Engineers, SPE-199870-MS, official proceedings for SPE/ICoTA Well Intervention Conference and Exhibition, Mar. 16, 2020, 12 pages.
Polyakov et al., "Dependence of magnetic permeability of ferromagnetic powder materials on particle size, " Powder Metallurgy and Metal Ceramics, 1995, 33: 9-10, 2 pages.
Roy et al., "Strategic Alliance Enables Fast-Track Engineering and Expeditious Deployment of Novel Flowable Sensors & Water Reactive Nano-Composite Plugs in MENA," OTC-31118-MS, Offshore Technology Conference, 2021, 16 pages.
Seren et al. "Electro-permanent magnetic weight release mechanism for buoyancy control of an autonomous well-logging tool." AIP Advances, Feb. 2021, 11:025117, 8 pages.
Seren et al., "Acoustic communication through well-head for untethered autonomous logging tool," The Journal of the Acoustical Society of America, 2020, 148, 2769, Abstract only, 4 pages.
Seren et al., "An Untethered Sensor Platform for Logging Vertical Wells," IEEE Transactions on Instrumentation and Measurement, Apr. 2018, 67(4), 6 pages.
Seren et al., "Autonomous Well Logging Robot with Passive Locomotion," 21st International Conference on Control, Automation and Systems (ICCAS), Dec. 2021, Abstract only, 3 pages.
Seren et al., "Untethered Well Logging Robot," Aramco Services Company, 2021, Summary, 1 page.
Seren et al., "Wireless Communication and Charging for an Untethered Downhole Logging Tool," IEEE Sensors, Oct. 27-30, 2019, 3 pages.
tervesinc.com [online], "Dissolvables," 2017, retrieved on Feb. 14, 2022, retrieved from URL <https://www.tervesinc.com/products/dissolvables/>, 6 pages.
Wikipedia.org [online], "Metacentric Height" Nov. 2003, [retrieved on Apr. 7, 2021], retrieved from: URL <https://en.wikipedia.org/wiki/Metacentric_height>, 7 pages.
Zeghlache et al., "An Innovative Deployment Technique to Optimize Logging Conveyance and Improve Data Quality," IPTC-21206-MS, International Petroleum Technology Conference, 2021, 16 pages.
Zeghlache et al., "Sensor-Ball: Field deployment of autonomous and untethered surveillance." IPTC-22255-MS, International Petroleum Technology Conference, Feb. 21-23, 2022, Abstract only, 6 pages.
Zhao et al., "Advanced Compound Coating for Delaying Corrosion of Fast-Dissolving Alloy in High Temperature and Corrosive Environment", International Scholarly and Scientific Research & Innovation, 2021, 15(2):71-75, 5 pages.
Zheng et al., "Ultralight, ultrastiff mechanical metamaterials," Science, Jun. 2014, 344(6190):1373-1377, 6 pages.

* cited by examiner

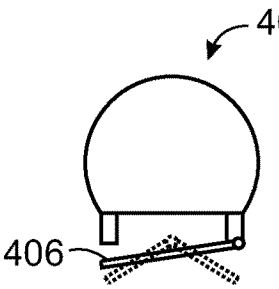
FIG. 5A
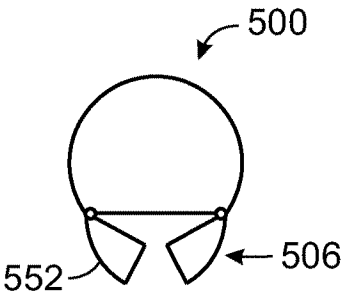
FIG. 6A
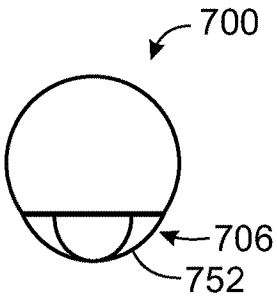
FIG. 7A
FIG. 8A
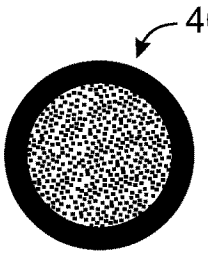
FIG. 5B
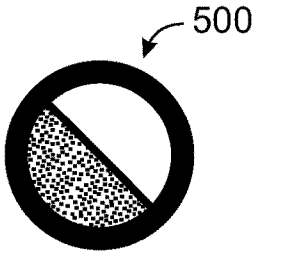
FIG. 6B
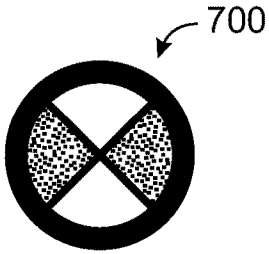
FIG. 7B
FIG. 8B
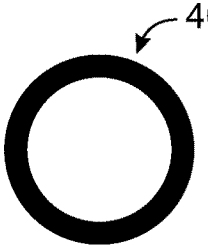
FIG. 5C
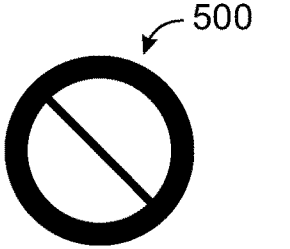
FIG. 6C
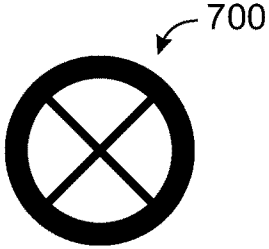
FIG. 7C
FIG. 8C

UNTETHERED LOGGING DEVICES AND RELATED METHODS OF LOGGING A WELLBORE

TECHNICAL FIELD

This disclosure relates to untethered devices, such as untethered logging devices that are designed to release an isolated ballast weight at a downhole position for reducing a device density and accordingly increasing a device buoyancy for floatation back to the surface.

BACKGROUND

Untethered devices in oil and gas applications refer to untethered logging, intervention, stimulation, or other devices that are unattached to the wellbore surface and deposited in the wellbore to descend in a downhole direction. Such untethered devices include sensors that are mounted on autonomous robots, single-use deployment sensors, and self-deployed sensors. An untethered device may include a weight-release mechanism whereby the device drops an exposed, degradable ballast weight at a downhole position along the wellbore to reduce its density and accordingly floats back upward to the surface. An electromagnet is used to hold the exposed ballast weight against a body of the device until the device reaches a required downhole position. Several challenges plague such untethered device designs, including premature release of the ballast weight, premature disintegration of the ballast weight, melting of a plastic screw holding the ballast weight to a metal component of the device, and disconnection of the ballast weight from the metal component at a relatively low temperature.

SUMMARY

This disclosure relates to untethered logging devices that are designed to release a material (e.g., an isolated ballast weight) at a predetermined downhole position along a wellbore for reducing a bulk density of the devices. Upon release of the material, the untethered logging devices float in an uphole direction towards the surface. The untethered logging devices are designed to log the wellbore while moving in both downhole and uphole directions within the wellbore.

In one aspect, an untethered device includes a housing, a chamber wall extending from the housing and defining a buoyancy chamber, and a discharge door. The discharge door is configured to be placed in a closed position that isolates a ballast weight within the buoyancy chamber and an open position that allows a release of the ballast weight from the untethered device to reduce a bulk density of the untethered device.

Embodiments may provide one or more of the following features.

In some embodiments, the ballast weight includes a powdered material.

In some embodiments the ballast weight includes material shavings.

In some embodiments, the ballast weight is unattached to all other components of the untethered device.

In some embodiments, the discharge door is pivotable with respect to the chamber wall between the closed and open positions.

In some embodiments, the untethered device further includes a lock-release mechanism that is configured to maintain the discharge door in a closed position during a period of time and to release the discharge door to an open position after the period of time.

In some embodiments, the untethered device further includes one or more sensors configured to measure one or more properties within a surrounding wellbore and circuitry configured to control the lock-release mechanism based on a detection of one or more predetermined values of the one or more properties, wherein the circuitry is programmed to automatically activate the lock-release mechanism upon the detection of at least one of the one or more predetermined values.

In some embodiments, the lock-release mechanism includes an electromagnet.

In some embodiments, the lock-release mechanism includes a lock pin.

In some embodiments, the lock pin is configured to melt or break at a predetermined temperature or configured to break at a predetermined hydrostatic pressure.

In some embodiments, the untethered device further includes one or more sensors configured to measure one or more properties within a surrounding wellbore.

In some embodiments, the untethered device is configured to continuously log the surrounding wellbore while the untethered device flows in a downhole direction and while the untethered device flows in an uphole direction.

In some embodiments, a weight of the untethered device is distributed such that the housing remains above the discharge door while the untethered device flows within a wellbore.

In some embodiments, the ballast weight includes one or more metals.

In some embodiments, the untethered device is an untethered logging device.

In some embodiments, the untethered device is an untethered intervention device.

In another aspect, a method of logging a wellbore includes isolating a ballast weight within a buoyancy chamber of an untethered logging device, dropping the untethered logging device in a downhole direction through the wellbore, automatically opening the buoyancy chamber at a predetermined position within the wellbore, releasing the ballast weight from the buoyancy chamber to reduce a bulk density of the untethered logging device, and flowing the untethered logging device in an uphole direction through the wellbore.

Embodiments may provide one or more of the following features.

In some embodiments, the ballast weight includes a powdered material or material shavings.

In some embodiments, the ballast weight is unattached to all other components of the untethered logging device.

In some embodiments, the method further includes measuring one or more properties within the wellbore while the untethered logging device flows in the downhole direction and in the uphole direction.

The details of one or more embodiments are set forth in the accompanying drawings and description. Other features, aspects, and advantages of the embodiments will become apparent from the description, drawings, and claims.

DESCRIPTION OF DRAWINGS

FIG. 5A is a side view of an example logging device with a spring-loaded discharge door.

FIGS. 5B and 5C are bottom views of the logging device of FIG. 5A with the discharge door open and closed, respectively.

FIG. 6A is a side view of an example logging device with a two-part hinged, chamber-forming discharge door.

FIGS. 6B and 6C are bottom views of the logging device of FIG. 6A with the discharge door open and closed, respectively.

FIG. 7A is a side view of an example logging device with a single-piece hinged, chamber-forming discharge door.

FIGS. 7B and 7C are bottom views of the logging device of FIG. 7A with the discharge door open and closed, respectively.

FIG. 8A is a side view of an example logging device with a multi-part hinged, chamber-forming discharge door.

FIGS. 8B and 8C are bottom views of the logging device of FIG. 8A with the discharge door open and closed, respectively.

DETAILED DESCRIPTION

Figure 1:
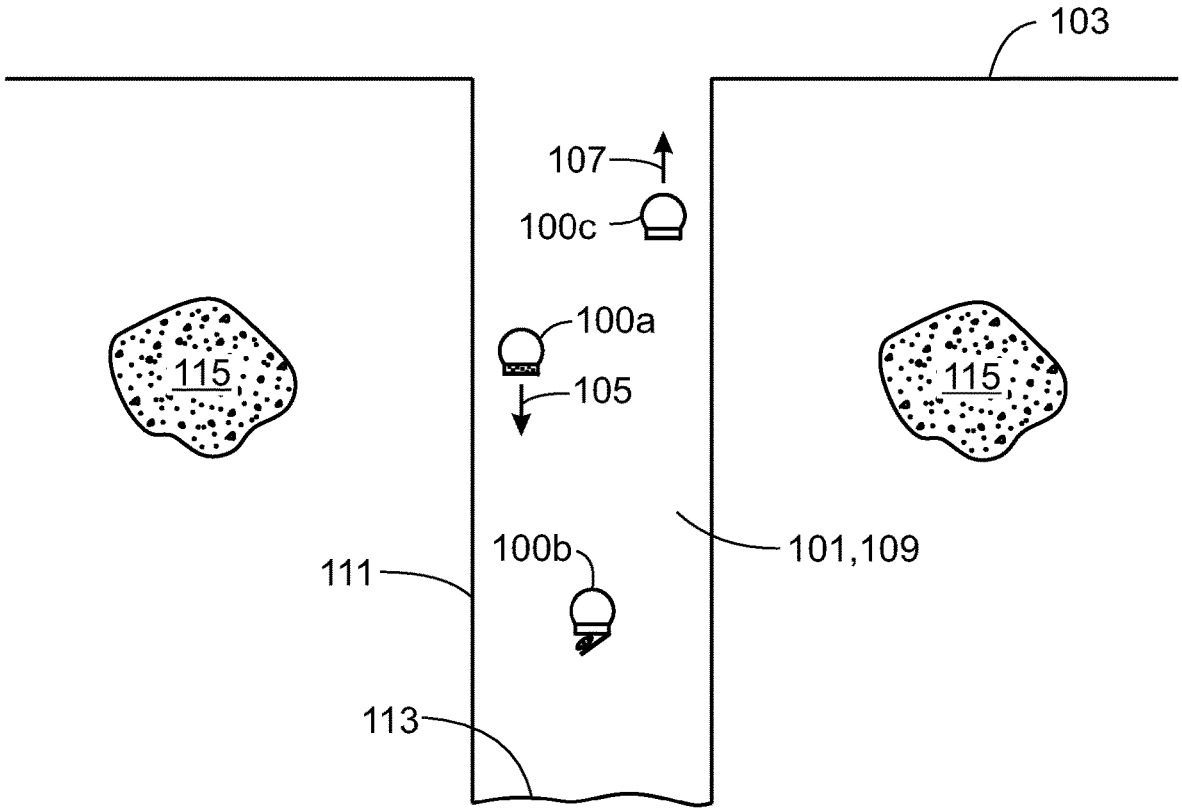
FIG. 1 is a diagram of example untethered logging devices within a wellbore.

FIG. 1 illustrates several example untethered logging devices 100 (e.g., 100*a*, 100*b*, 100*c*) for measuring properties (e.g., collecting data) along a wellbore 101 to log the wellbore 101. Such untethered devices can also be employed for surface pipeline applications. Such properties may be related to one or more of wellbore fluid 109 within the wellbore 101, a rock formation 115 in which the wellbore 101 is formed, or properties of a well completion pipeline (e.g., an internal diameter, corrosion characteristics, leaks, or other properties). The untethered logging devices 100 are unattached (e.g., either directly or indirectly) to a surface 103 from which the wellbore 101 extends. The untethered logging devices 100 are deployable to the wellbore 101 to move in a downhole direction 105 through the wellbore fluid 109 while logging the wellbore 101 (e.g., refer to 100*a*), to increase their buoyancy at a predetermined (e.g., preset or preprogrammed) axial position 111 (e.g., depth) along the wellbore 101, and to consequently move in an uphole direction 107 through the wellbore fluid 109 while logging the wellbore 101 (e.g., refer to 100*c*). In some implementations, the axial position 111 is determined based on a required intervention depth or survey interval. In some implementations, the axial position 111 may be arbitrarily based on a total depth of the wellbore 101 any maximum attained depth if a target depth is not predetermined.

Figure 2:
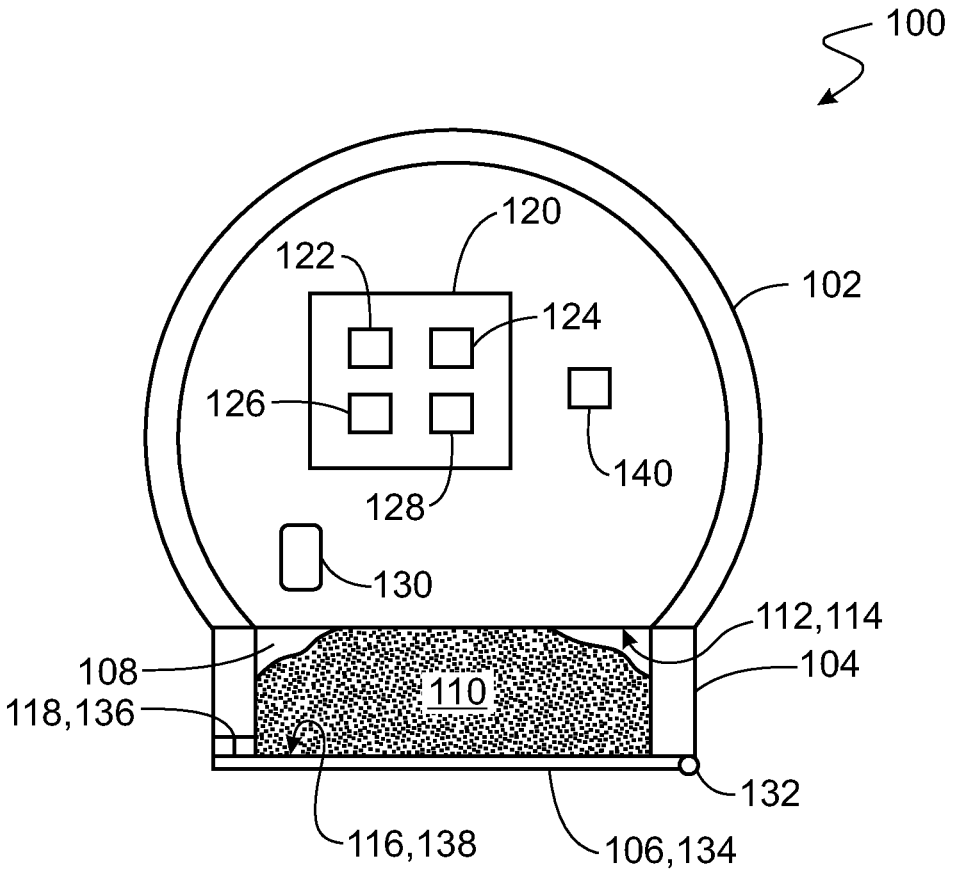
FIG. 2 is a cross-sectional view of an example untethered logging device of FIG. 1 including an electromagnetic lock-release mechanism.

FIG. 2 illustrates a cross-sectional view of an example untethered logging device 100. The untethered logging device 100 includes a main housing 102 that contains or otherwise protects various internal components, a chamber wall 104 that extends from the main housing 102, and a discharge door 106 that is openable from the chamber wall 104 and closeable against the chamber wall 104. The main housing 102 has a substantially frusto-spherical shape (e.g., the shape of a partial sphere) such that the untethered logging device 100 may sometimes be referred to as a sensor ball. The chamber wall 104 has a substantially cylindrical shape and defines a buoyancy chamber 108 (e.g., a hollow region) that has a substantially circular cross-sectional shape. The buoyancy chamber 108 contains a material 110 (e.g., a releasable ballast weight) that is dischargeable from the untethered logging device 100 at the predetermined axial position 111 along the wellbore 101 or that begins to gradually discharge at or near the predetermined axial position 111. A lower surface 112 of the main housing 102 defines an uphole end 114 of the buoyancy chamber 108, and an inner surface 138 of the discharge door 106 defines a downhole end 116 of the buoyancy chamber 108.

The material 110 within the buoyancy chamber 108 affects the overall (e.g., bulk) density of the untethered logging device 100. Therefore, a presence or absence of the material 110 within the buoyancy chamber 108 governs whether the untethered logging device 100 descends (e.g., sinks) in the downhole direction 105 or ascends (e.g., floats upwards) in the uphole direction 107 through the wellbore fluid 109. For example, when the discharge door 106 is closed during initial deployment of the untethered logging device 100, the material 110 is contained within the buoyancy chamber 108 (refer to 100*a* in FIG. 1) such that the bulk density of the untethered logging device 100 is greater than a density of the wellbore fluid 109. This positive differential in density renders the untethered logging device 100 relatively non-buoyant, causing the untethered logging device 100 to descend through the wellbore fluid 109 in the downhole direction 105. In contrast, once the discharge door 106 has been opened to release the material 110 from the buoyancy chamber 108 (refer to 100*b* in FIG. 1), the buoyancy chamber 108 is empty or partially empty (refer to 100*c* in FIG. 1) to the extent that the overall density of the untethered logging device 100 is less than the density of the wellbore fluid 109. This negative differential in density renders the untethered logging device 100 relatively buoyant, causing the untethered logging device 100 to ascend through the wellbore fluid 109 in the uphole direction 107 towards the surface 103. Such ascension will occur even if a residual portion of the material 110 remains within the buoyancy chamber 108, as long as the negative differential in density is present.

In some embodiments, the material 110 is degradable upon contact with the wellbore fluid 109 over a sufficient period of time (e.g., about 2 h to about 72 h). However, in contrast to conventional untethered logging tools that utilize a ballast weight for changing tool density, the material 110 is protected from (e.g., isolated from or unexposed to) the wellbore fluid 109 until the time that the material 110 is to be released at the predetermined axial position 111. In other words, the material 110 is protected from the wellbore fluid 109 while the discharge door 106 is closed against the chamber wall 104 during a downhole run of the untethered logging device 100. Advantageously, this design of the untethered logging device 100 prevents premature release and disintegration of the material 110 or otherwise premature decoupling of the material 110 from the untethered logging device 100.

In some embodiments, the material 110 may be provided as one or both of a powder and shavings that have been formed from a base material. Advantageously, the base material may be provided as a recycled material, thereby providing a positive impact on the environment. The base material may be one or more relatively heavy materials, such as metals (e.g., carbon steel, copper, mercury, lead, alloys, and other metals) or other materials, whether solids or liquids (e.g., rock particles, cement chips, sand, and other materials). The powdered particles or shavings forming the material 110 are unattached to any other component of the untethered logging device 100. Advantageously, such a design of the untethered logging device 100 allows the material 110 to be freely released from the buoyancy chamber 108 once the discharge door 106 opens from the chamber wall 104.

Several additional advantages arise from utilizing a powder or shavings form of the material 110. For example, relative to a conventional design that may incorporate a ballast weight as solid composite block that is exposed to wellbore fluid, the form of the material 110 results in a reduced cost because little to no engineering or manufacturing is required to produce the powder or shavings. Furthermore, as compared to a conventional design utilizing a solid, exposed composite block, the simple, straightforward use of powder or shavings allows for a relatively small footprint of the untethered logging device 100 as a result of a simplified lock-release mechanism 118, which will be discussed in more detail below. The degradable property of the powder and shavings also ensures that no metal components are left in the wellbore 101. Additionally, use of the powder and shavings eliminates a risk of damaging the untethered logging device 100 due to an exothermic chemical reaction that would otherwise occur between the solid, exposed composite block and wellbore fluid 109 for a conventional design. This is especially true in cases of premature degradation of a dissolvable ballast while still connected to the device.

Referring still to FIG. 2, the example untethered logging device 100 further includes a lock-release mechanism 118 that effects operation of the discharge door 106, circuitry 120 that controls the lock-release mechanism 118 and other functionalities of the untethered logging device 100, and a battery 130 that powers various components of the untethered logging device 100. Operation of the discharge door 106 may include automatic opening of the discharge door 106 at the predetermined axial position 111 and automatic closing of the discharge door 106 following release of the material 110 from the buoyancy chamber 108. In some embodiments, automatic closing of the discharge door 106 reduces wear and tear on the discharge door 106 and its locking mechanism. In some embodiments, the circuitry 120 includes a receiver 122, a transmitter 124, a controller 126, and one or more processors 128 for controlling the lock-release mechanism 118 and other functionalities of the untethered logging device 100.

In the example untethered logging device 100, the lock-release mechanism 118 is an electromagnetic lock-release mechanism that includes an electromagnet 136 (e.g., a metal) that is coupled to the battery 130. Therefore, in the example untethered logging device 100, the discharge door 106 is made of one or more ferromagnetic materials, such as carbon steel. The electromagnet 136 is magnetized by the battery 130 and accordingly holds the discharge door 106 closed against the electromagnet 136 until the untethered logging device 100 reaches the predetermined axial position 111.

When the untethered logging device 100 reaches the predetermined axial position 111, the battery 130 automatically ceases to power the electromagnet 136 such that the discharge door 106 is permitted to swing open from the chamber wall 104. In some examples, the battery 130 acts to preserve battery life. Opening of the discharge door 106 allows the material 110 to spill out from the buoyancy chamber 108 into the wellbore fluid 109. In some embodiments, an electrical shield may be coated onto or otherwise installed to the chamber wall 104 to electrically isolate the material 110 from the chamber wall 104 if the material 110 has ferromagnetic properties that would tend to cause some of the material 110 to stick to the chamber wall 104 even after the lock-release mechanism 118 has been activated. In some embodiments, the buoyancy chamber 108 is pressurized or pressure-compensated to ensure that the discharge door 106 can open under a hydrostatic pressure of the wellbore fluid 109.

As discussed above, operation (e.g., opening) of the discharge door 106 is automatic. The automatic operation may be triggered by a preset elapsed of time (e.g., a mission time) that has passed, a preset temperature within the wellbore 101, or a preset pressure within the wellbore 101, whichever occurs first. Such preset parameters are associated with the predetermined axial position 111. Accordingly, the untethered logging device 100 includes one or more sensors 140 that are continuously powered by the battery 130 and designed to measure elapsed time, temperature, and pressure within the wellbore 101 continuously and in real time. The continuous measurements are utilized for both activation of the discharge door 106 and logging of the wellbore 101 while the untethered logging device 100 descends and ascends through the wellbore fluid 109.

In addition to measuring the elapsed time, temperature, and pressure, the one or more sensors 140 are further designed to measure one or more other physical, chemical, geological, or structural properties along the wellbore 101 during a logging operation. Example properties include wellbore fluid measurements (e.g., density, viscosity, salinity, pH, and other wellbore fluid measurements), wellbore measurements (e.g., deviation, azimuth, diameter, radius, and other wellbore measurements), and formation or casing measurements (e.g., casing thickness, scale, corrosion, leaks, formation porosity, density, saturation, and other measurements). During the logging operation, the transmitter 124 sends data carrying the real-time measurements to one or more devices located at the surface 103 for further processing of the data.

Additionally, the untethered logging device 100 is designed such that the discharge door 106 can alternatively open as a safety response to a failure, an otherwise electrical or mechanical malfunction, an obstruction, or a stuck position of the untethered logging device 100 within the wellbore 101. Such scenarios may cause the untethered logging device 100 to enter an "SOS" mode that triggers the safety response. In some embodiments, failure or malfunctioning of the untethered logging device 100 may be determined from internal voltages and currents. In some embodiments, obstruction of the untethered logging device 100 or a stuck position of the untethered logging device 100 along the wellbore 101 may be determined by an on-board accelerometer or by sensor measurements that are constant (e.g., indicating no change in the surrounding wellbore environment). In some embodiments, the discharge door 106 closes automatically upon release of the material 110. Such closure may be triggered automatically by a sensed depth, a sensed change in pressure, or an elapsed time, whichever comes first. In some embodiments, if the device 100 goes into "SOS" mode, automatic closure of the discharge door 106 may be disabled automatically to ensure that any residual material 110 is discharged so that the device 100 can be retrieved.

In the example untethered logging device 100, the discharge door 106 includes a hinge 132 and a lid 134 that pivots (e.g., swings) with respect to the chamber wall 104 at the hinge 132. In some embodiments, the lid 134 may be formed as a single piece or from multiple pieces. In some embodiments, the lid 134 may be designed to pivot open from the hinge 132 under a gravitational force of the weight of the material 110, or the lid 134 may be alternatively or additionally spring-loaded to facilitate quick, proper opening of the discharge door 106. Due to the length of the discharge door 106, the discharge door 106 needs a minimum clearance distance between the hinge 132 and a downhole (e.g., bottom) end 113 of the wellbore 101 or any other obstruction in order to sufficiently swing open for release of the material 110. In an undesirable scenario where the untethered logging device 100 is sitting atop the downhole end 113 or an obstruction within the wellbore 101, the discharge door 106 may rely on the action of a spring to facilitate opening of the discharge door 106. In other such instances, the discharge door 106 may rely on lateral movement of the untethered logging device 100 due to intentional flowing of the wellbore fluid 109 to facilitate opening of the discharge door 106.

The weight of the untethered logging device 100 is distributed (e.g., a center of gravity of the untethered logging device 100 is located) such that the untethered logging device 100 remains substantially in the upright orientation shown in FIG. 2 at all times (e.g., including while descending and ascending within the wellbore fluid 109). Such an orientation ensures that the discharge door 106 faces substantially in the downhole direction 103 at all times. For example, a combination of the main housing 102 and the various components (e.g., the circuitry 120, the battery 130, and the one or more sensors 140) contained therein weigh less and are less dense than a combination of the chamber wall 104, the lock-release mechanism 118, and the discharge door 106. In some embodiments, a weight of the untethered logging device 100, excluding the material 110, is in a range of about 50 g to about 300 g. In some embodiments, the weight of the material 110 is in a range of about 30 g to about 300 g.

With the discharge door 106 in the closed configuration, the untethered logging device 100 typically has a total height of about 5 cm to about 10 cm. The untethered logging device 100 typically has a width (e.g., determined by a diameter of the main housing 102) of about 5 cm to about 10 cm. As discussed above with respect to the discharge door 106, each of the main housing 102 and the chamber wall 104 may be made of one or more materials. Example materials from which the main housing 102 and the chamber wall 104 may be made include metal alloys, carbon or glass fiber, plastics, or composites.

Figure 3:
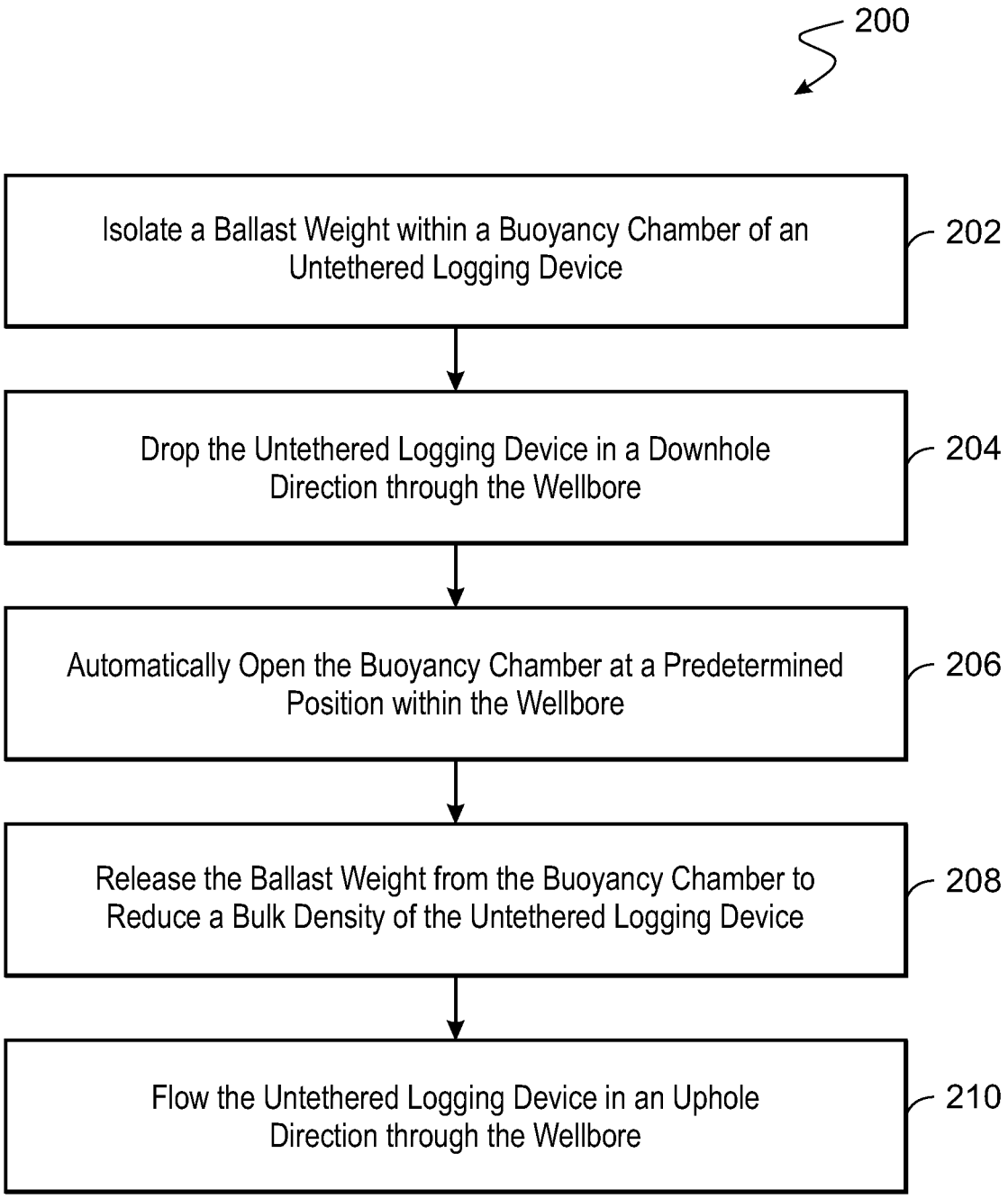
FIG. 3 is a flow chart illustrating an example method of logging a wellbore using an untethered logging device of FIGS. 1 and 2.

FIG. 3 is a flow chart illustrating an example method 200 of logging a wellbore (e.g., the wellbore 101). In some embodiments, the method 200 includes a step 202 for isolating (e.g., loading and isolating) a ballast weight (e.g., the material 110) within a buoyancy chamber (e.g., the buoyancy chamber 108) of an untethered logging device (e.g., the untethered logging device 100). In some embodiments, the method 200 includes a step 204 for dropping the untethered logging device in a downhole direction (e.g., the downhole direction 105) through the wellbore. In some embodiments, the method 200 includes a step 206 for automatically opening the buoyancy chamber at a predetermined position (e.g., the predetermined axial position 111) within the wellbore. In some embodiments, the method 200 includes a step 208 for releasing the ballast weight from the buoyancy chamber to reduce a bulk density of the untethered logging device. In some embodiments, the method 200 includes a step 210 for flowing the untethered logging device in an uphole direction (e.g., the uphole direction 107) through the wellbore.

While the untethered logging device 100 has been described and illustrated with respect to certain dimensions, sizes, shapes, arrangements, materials, and methods 200, in some embodiments, an untethered logging device that is otherwise substantially similar in construction and function to the untethered logging device 100 may include one or more different dimensions, sizes, shapes, arrangements, configurations, and materials or may be utilized according to different methods.

Figure 4:
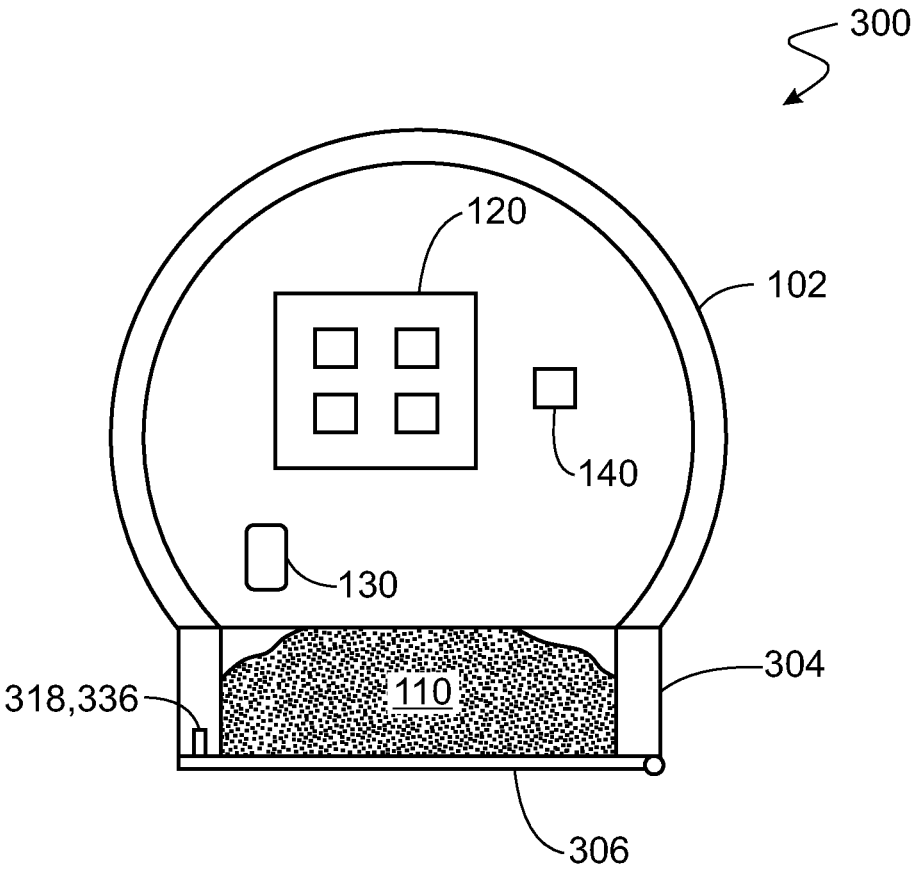
FIG. 4 is a cross-sectional view of an example untethered logging device including a thermal or mechanical lock-release mechanism.

For example, FIG. 4 illustrates an example untethered logging device 300 that includes a lock-release mechanism 318 of a different form. The untethered logging device 300 is otherwise substantially similar in construction and function to the untethered logging device 100. Accordingly, the untethered logging device 300 includes the main housing 102, the circuitry 130, the battery 130, the one or more sensors 140, and the material 110. The untethered logging device 300 further includes a chamber wall 304 and a discharge door 306 that are designed to mechanically interface with the lock-release mechanism 318. The chamber wall 304 and the discharge door 306 are otherwise substantially similar in construction and function to the chamber wall 104 and the discharge door 106, respectively.

The lock-release mechanism 318 includes a lock pin 336 that secures the discharge door 306 to the chamber wall 304. In some embodiments, the lock-release mechanism 318 is a thermal mechanism such that the lock pin 336 melts or breaks to release the discharge door 306 upon detection of a preset temperature by the one or more sensors 140. In some embodiments, the lock-release mechanism 318 is a mechanical mechanism such that the lock pin 336 shears to release the discharge door 306 upon exposure to a preset hydrostatic pressure of the wellbore fluid 109. In some embodiments, the discharge door 306 may be made of one or more ferromagnetic materials discussed above with respect to the discharge door 106 or may be made of one or more non-ferromagnetic materials, such as a metal alloy, a ceramic, carbon or glass fiber, or plastics or composites.

In some embodiments, an untethered logging device that is otherwise substantially similar in construction and function to the untethered logging device 100 or 300 alternatively includes an electrical lock-release mechanism that triggers activation (e.g., opening) of the discharge door when a thermistor of the untethered logging device detects a preset temperature. In such an embodiment, the electromagnet 136 or the lock pin 336 may be used as part of the lock-release mechanism.

In some embodiments, an untethered logging device that is otherwise substantially similar in construction and function to the untethered logging device 100 or 300 alternatively includes a disposable discharge door as a lock-release mechanism. Such a disposable discharge door may be designed to dissolve, burst, or disconnect at a preset temperature or pressure. In some embodiments, the disposable door may be made of glass, ceramic, or a composite material.

While the untethered logging devices 100, 300 and others have been described and illustrated as including a hinged, swinging discharge door 106, 306, in some embodiments, an untethered logging device that is otherwise substantially similar in construction and function to any of the above-discussed untethered logging devices may alternatively include a discharge door with a sliding-gate design.

FIGS. 5A-8C illustrate untethered logging devices 400, 500, 600, 700 with alternative forms of discharge doors or discharge gates. The untethered logging devices 400, 500, 600, 700 are otherwise substantially similar in construction and function to any of the above-discussed untethered logging devices. FIGS. 5A-5C illustrate a side view of the untethered logging device 400 and bottom views of the untethered logging device 400 with a discharge door 406 open and closed. The untethered logging device 400 includes a discharge door 406. The dashed line illustrates that the position of the hinge can be to the side, offset, or centered to allow multiple configurations. FIGS. 6A-6C illustrate a side view of the untethered logging device 500 and bottom views of the untethered logging device 500 with a discharge door 506 open and closed. The discharge door 506 also functions as a chamber wall and includes two hinged components 552 that open away from a housing to release a material and that are closed against each other at the housing during initial deployment. The hinged components 552 form receptacles that support the material 110 in the closed position. FIGS. 7A-7C illustrate a side view of the untethered logging device 600 and bottom views of the untethered logging device 600 with a discharge door 606 open and closed. The discharge door 606 also functions as a chamber wall and includes a single, hinged, frusto-spherical component 652 that opens away from a housing to release a material and that is closed against the housing during initial deployment. The hinged components 652 forms a receptacle that supports the material 110 in the closed position. FIGS. 8A-8C illustrate a side view of the untethered logging device 700 and bottom views of the untethered logging device 700 with a discharge door 706 open and closed. The discharge door 706 also functions as a chamber wall and includes a sliding door and a fixed door 752 that open away from a housing to release a material and that are closed against each other at the housing during initial deployment. The doors 752 together form a receptacle that supports the material 110 in the closed position. In FIGS. 6B, 6C, 7B, 7C, 8B, and 8C, the dividing lines represent internal walls that divide the buoyancy chambers into separate compartments such that the material release can be through full, single, or multiple pathways.

In some embodiments, while the material 110 has been described as a powdered substance or material shavings, in some embodiments, a untethered logging device that is otherwise substantially similar to any of the above-discussed untethered logging devices may include a ballast material that is provided generally as a non-molded weight that may not have a bulk capsule form. In other embodiments, the material may be provided as a relatively heavy liquid (e.g., mercury) that is not degradable upon contact with the wellbore fluid.

While the safety mechanism has been described above as triggering activation of the discharge door 106 due to a failure, malfunction, obstruction, or stuck position and without any additional hardware components needed in the untethered logging device, in some embodiments, a logging that is otherwise substantially similar to any of the above-discussed untethered logging devices may include a fail-safe mechanism that triggers automatic opening or release of discharge door and/or the entire release of chamber wall should the untethered logging device experience distress for a sufficient period of time.

While the device 100 has been described as an untethered logging device, in some embodiments, another type of untethered device that is otherwise similar in construction and function to the device 100 can include the ballast weight-release mechanisms described above. Such devices include intervention devices, stimulation devices, and other types of untethered devices.

Other embodiments are also within the scope of the following claims.

What is claimed is:

1. An untethered device comprising:
- a housing;
- a chamber wall externally extending from the housing and defining a buoyancy chamber; and
- a discharge door that is configured to be placed in:
  - a closed position that isolates a ballast weight within the buoyancy chamber, and
  - an open position that allows a release of the ballast weight from the untethered device to reduce a bulk density of the untethered device,
- wherein the buoyancy chamber is delimited by:
- a lower surface of the housing that establishes an uphole end of the buoyancy chamber,
- an inner surface of the discharge door that defines a downhole end of the buoyancy chamber, and
- the chamber wall.

2. The untethered device of claim 1, wherein the ballast weight comprises a powdered material.

3. The untethered device of claim 1, wherein the ballast weight comprises material shavings.

4. The untethered device of claim 1, wherein the ballast weight is unattached to all other components of the untethered device.

5. The untethered device of claim 1, wherein the discharge door is pivotable with respect to the chamber wall between the closed and open positions.

6. The untethered device of claim 1, further comprising a lock-release mechanism that is configured to maintain the discharge door in the closed position during a period of time and to release the discharge door to the open position after the period of time.

7. The untethered device of claim 6, further comprising:
- one or more sensors configured to measure one or more properties within a surrounding wellbore; and
- circuitry configured to control the lock-release mechanism based on a detection of one or more predetermined values of the one or more properties, wherein the circuitry is programmed to automatically activate the lock-release mechanism upon the detection of at least one of the one or more predetermined values.

8. The untethered device of claim 6, wherein the lock-release mechanism comprises an electromagnet.

9. The untethered device of claim 6, wherein the lock-release mechanism comprises a lock pin.

10. The untethered device of claim 9, wherein the lock pin is configured to melt or break at a predetermined temperature or configured to break at a predetermined hydrostatic pressure.

11. The untethered device of claim 1, further comprising one or more sensors configured to measure one or more properties within a surrounding wellbore.

12. The untethered device of claim 1, wherein the untethered device is configured to continuously log the surrounding wellbore while the untethered device flows in a downhole direction and while the untethered device flows in an uphole direction.

13. The untethered device of claim 1, wherein a weight of the untethered device is distributed such that the housing remains above the discharge door while the untethered device flows within a wellbore.

14. The untethered device of claim 1, wherein the ballast weight comprises one or more metals.

15. The untethered device of claim 1, wherein the untethered device comprises an untethered logging device.

16. The untethered device of claim 1, wherein the untethered device comprises an untethered intervention device.

17. A method of logging a wellbore, the method comprising:

isolating a ballast weight within a buoyancy chamber of an untethered logging device, wherein the buoyancy chamber is delimited by:

a lower surface of a housing of the untethered logging device, the lower surface establishing an uphole end of the buoyancy chamber, an inner surface of a discharge door configured to release the ballast weight, the inner surface defining a downhole end of the buoyancy chamber, and a chamber wall externally extending from the housing;

dropping the untethered logging device in a downhole direction through the wellbore;

automatically opening the buoyancy chamber at a predetermined position within the wellbore;

releasing the ballast weight from the buoyancy chamber to reduce a bulk density of the untethered logging device; and flowing the untethered logging device in an uphole direction through the wellbore.

18. The method of claim 17, wherein the ballast weight comprises a powdered material or material shavings.

19. The method of claim 18, wherein the ballast weight is unattached to all other components of the untethered logging device.

20. The method of claim 17, further comprising measuring one or more properties within the wellbore while the untethered logging device flows in the downhole direction and in the uphole direction.

* * * * *